US008127469B2

(12) United States Patent
Keenan et al.

(10) Patent No.: US 8,127,469 B2
(45) Date of Patent: Mar. 6, 2012

(54) FOOTWEAR SOLE WITH A REMOVABLE HEEL INSERT

(75) Inventors: Ryan W. Keenan, San Clemente, CA (US); Steven M. Lebrasseur, Aliso Viejo, CA (US); William D. Goloveyko, Long Beach, CA (US)

(73) Assignee: Quicksilver, Inc., Huntington Beach, CA (US)

( * ) Notice: Subject to any disclaimer, the term of this patent is extended or adjusted under 35 U.S.C. 154(b) by 784 days.

(21) Appl. No.: 12/187,328

(22) Filed: Aug. 6, 2008

(65) Prior Publication Data

US 2010/0031533 A1 Feb. 11, 2010

(51) Int. Cl.
*A43B 21/32* (2006.01)

(52) U.S. Cl. ..... 36/37; 36/36 R; 36/100; 36/15

(58) Field of Classification Search ..... 36/105, 36/28, 100, 15, 35 R, 36 R, 37, 136
See application file for complete search history.

(56) References Cited

U.S. PATENT DOCUMENTS

| | | | | | |
|---|---|---|---|---|---|
| 1,751,069 | A * | 3/1930 | Blain | 36/1 |
| 2,904,901 | A * | 9/1959 | Goldstein | 36/1 |
| 3,325,918 | A * | 6/1967 | Weitzner | 36/1 |
| 4,843,741 | A * | 7/1989 | Yung-Mao | 36/114 |
| 4,942,677 | A * | 7/1990 | Flemming et al. | 36/27 |
| 5,212,878 | A * | 5/1993 | Burke et al. | 36/27 |
| 5,373,649 | A | 12/1994 | Choi | |
| 5,438,768 | A | 8/1995 | Bauerfeind | |
| 5,651,196 | A * | 7/1997 | Hsieh | 36/27 |
| 5,685,090 | A * | 11/1997 | Tawney et al. | 36/29 |
| 5,692,322 | A | 12/1997 | Lombardino | |
| 5,983,529 | A * | 11/1999 | Serna | 36/28 |
| 6,023,859 | A * | 2/2000 | Burke et al. | 36/105 |
| 6,243,974 | B1 * | 6/2001 | Schaj | 36/136 |
| 6,711,835 | B1 | 3/2004 | Militello | |
| 7,073,276 | B2 * | 7/2006 | Swigart | 36/29 |
| 7,228,648 | B2 * | 6/2007 | Yang | 36/35 R |
| 7,334,352 | B2 * | 2/2008 | Lacey | 36/28 |
| 7,418,793 | B2 * | 9/2008 | Dominguez et al. | 36/136 |
| 2004/0068892 | A1 * | 4/2004 | Wang | 36/28 |
| 2005/0172520 | A1 * | 8/2005 | Simmons-Gettig | 36/136 |
| 2007/0294917 | A1 * | 12/2007 | Holden et al. | 36/29 |

OTHER PUBLICATIONS

2008 Product Catalog, www.reef.com, 2 pages, May 14, 2007.

* cited by examiner

*Primary Examiner* — Marie Patterson
(74) *Attorney, Agent, or Firm* — Snell & Wilmer LLP

(57) ABSTRACT

The invention relates to an article of footwear having a hollow heel cavity that is adapted to receive a heel insert. A user can interchange heel inserts of varying thicknesses based on their activity, and is not required to change their footwear when undertaking a new activity. For example, hiking on a dirt trail may require a heel insert with less cushioning and more support, while running on pavement may require a heel insert with more cushioning and less support. The user can simply carry with him multiple heel inserts and replace the heel insert as needed to achieve a desired level of support, cushioning and comfort.

20 Claims, 9 Drawing Sheets

FOOTWEAR SOLE WITH A REMOVABLE HEEL INSERT

BACKGROUND

1. Field

The present invention relates generally to an improved heel for footwear and, more particularly, to a heel insert for footwear that can be replaced to achieve a desired level of support, cushioning, and comfort.

2. Description of the Related Art

Footwear, such as sandals and shoes, designed for walking and other forms of exercising typically include a laminated sole attached to a soft and pliable upper. The laminated sole generally includes a resilient rubber outsole attached to a more resilient sole usually made of polyurethane, ethylene vinyl acetate (EVA), or a rubber compound. When laminated, the sole is attached to the upper as a one-piece structure, with the rear sole being integral with the forward sole.

The heel of the rear sole is generally the first part of footwear to impact the ground. This heel strike, as it is generally known, places extra stress on the heel and can lead to unnecessary repetitive motion injury. Footwear designers have long recognized that shock absorption and diffusion are necessary to reduce the stress on initial impact of the heel.

One problem associated with traditional footwear is that it provides the same level of heel support and cushioning regardless of the user's activity. For example, traditional footwear designed for walking or running usually has cushioned and flexible soles to promote a natural gait on hard surfaces such as asphalt or concrete, while hiking footwear usually has stiffer soles to protect against sharp rocks and other objects typically encountered on the trail. However, a user receives the same level of heel support and cushioning if they choose to wear the same article of footwear for both activities. This may not be ideal as the user may receive too little or too much support and cushioning depending on his activity.

A solution to this problem would be for the user to buy multiple shoes with different levels of heel support and cushioning, and to change the footwear based on the activity they are participating in. This solution, however, can be expensive as it requires the user to purchase multiple shoes for each activity they are participating in. This can be impractical if the user participates in numerous activities that each requires a different level of heel support and cushioning.

Furthermore, this solution is cumbersome if the user is hiking, for instance, on paths in the woods, then on a road surface, and finally on the beach, all in one outing. Each of these surfaces requires a different level of heel support and cushioning, thus the user would need to carry three different articles of footwear while they are hiking.

Thus, there is a need for an improved article of footwear that has an adjustable heel support to provide a proper level of support, cushioning and comfort based on the activity the user is participating in.

SUMMARY

In one embodiment, the present invention relates to an article of footwear comprising: a sole having a smooth top surface adapted for placement of a user's foot and a treaded bottom surface adapted for placement on a ground surface; a securing device on the top surface of the sole and adapted to receive the user's foot; a heel portion defining a hollow cavity positioned at the rear portion of the bottom surface of the sole, the heel portion having an upper surface, a lower surface, and two flexible side walls, and the heel portion having an open front portion and a closed rear portion; a plurality of connectors positioned on each side wall connecting the upper surface of the heel portion and the lower surface of the heel portion, the plurality of connectors spaced apart by openings in each side wall; a recessed portion defining a gripping area for fingers positioned at the front portion of the lower surface of the heel portion; and a removable insert placed inside the hollow cavity through the front portion to adjust the level of support provided to the heel.

BRIEF DESCRIPTION OF THE DRAWINGS

These and other embodiments of the present invention will be discussed with reference to the following non-limiting and exemplary illustrations, in which like elements are numbered similarly, and where.

DETAILED DESCRIPTION

Figure 1:
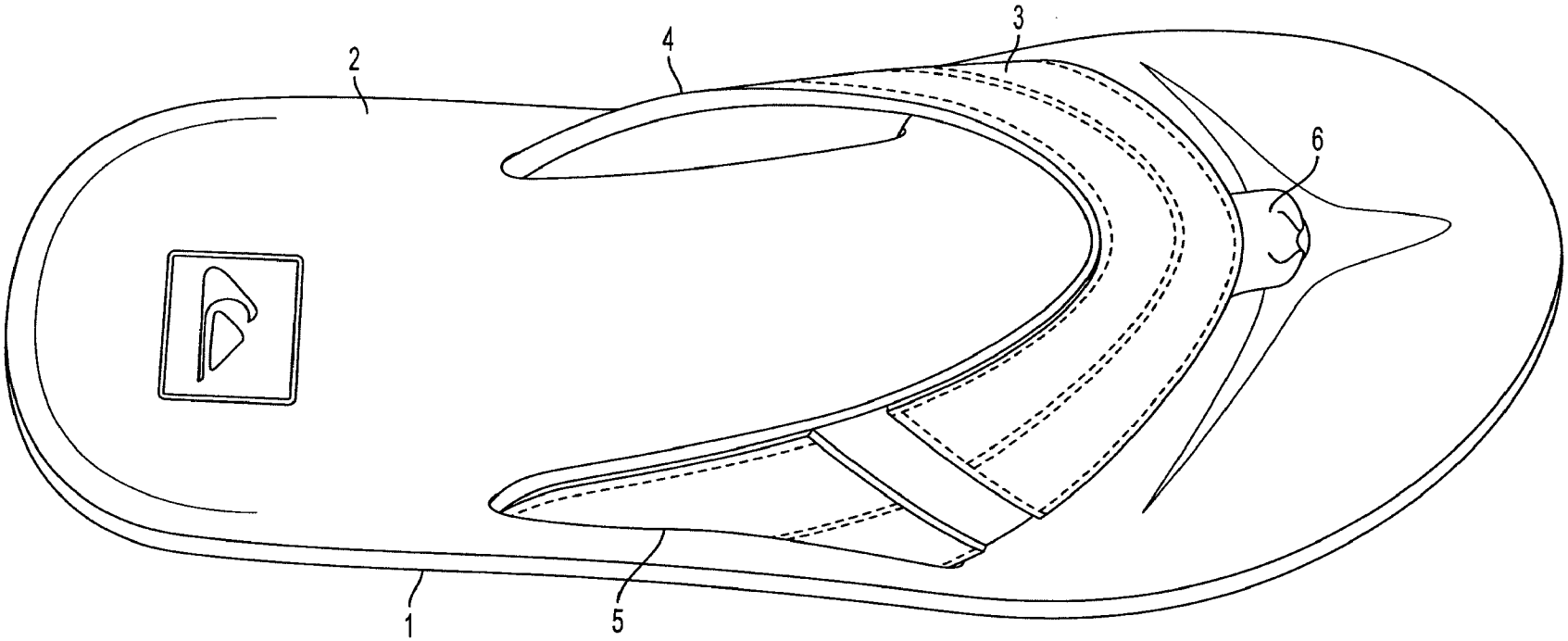
FIG. 1 is a top view of a sandal in accordance with an embodiment of the present invention.

FIG. 1 is a top view of a sandal 1 in accordance with an embodiment of the present invention. Upper surface 2 of sandal 1 is generally composed of rubber, polyurethane, foamed ethylene vinyl acetate (EVA), butadiene, styrene butadiene, isoprene, or any material with comparatively good flexibility. Upper surface 2 is preferably contoured in a concave manner to accommodate the underside of wearer's foot, and in particular, to provide support and comfort.

Sandal 1 comprises securing device 3 to secure a user's foot at a position where a gap exists between the big toe and the adjacent toe when the foot is placed on upper surface 2. Securing device 3 may be a strap having strap ends 4 and 5 and tab 6. Tab 6 is fixed to upper surface 2 preferably by a rivet. Strap ends 4 and 5 may be connected to opposite longitudinal sides of upper surface 2 preferably by thermo-compression bonding. However, any suitable means of fastening both tab 6 and strap ends 4 and 5 to upper surface 2 may be utilized. In one embodiment of the present invention, securing device 3 may be laces, a thong strap, a closed-toe covering or any other means to hold the user's foot securely to the sole of the article of footwear.

Figure 2:
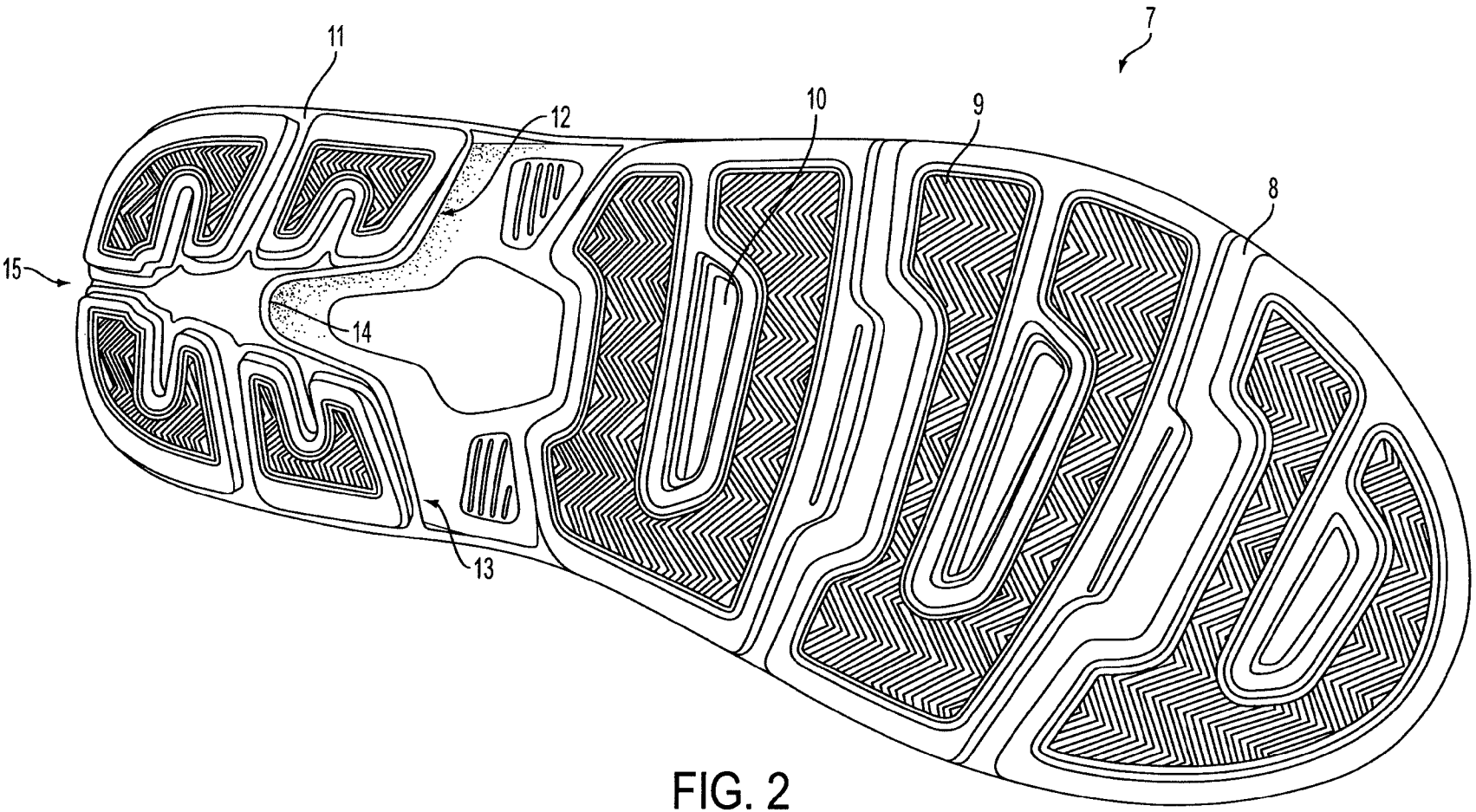
FIG. 2 is a perspective view of a bottom portion of the sandal of FIG. 1 in accordance with an embodiment of the present invention.

FIG. 2 is a perspective view of a bottom portion (i.e., a sole) of the sandal 1 of FIG. 1 in accordance with an embodiment of the present invention. Sole 7 of sandal 1 is generally composed of rubber, polyurethane, foamed EVA, butadiene, styrene butadiene, isoprene, or any material with comparatively good flexibility. Sole 7 preferably comprises traction grooves 9 and channels 10 to improve traction and prevent slippage when sole 7 is placed on a ground surface.

Sole 7 includes front surface 8 and heel surface 11. Underneath the heel surface 11 is a hollow heel cavity 12. Heel cavity 12 is adapted to receive a heel insert that allow the user to adjust the level of support and cushioning that is provided to heel surface 11. Heel surface 11 is preferably flexible and expandable to allow for various sized heel inserts to be placed in heel cavity 12. Heel surface 11 comprises a recessed center portion 14 to facilitate insertion and removal of heel inserts. Heel cavity 12 has an open front portion 13 where heel inserts can be placed inside heel cavity 12 and a closed rear portion 15 to secure heel inserts within heel cavity 12.

Figure 3:
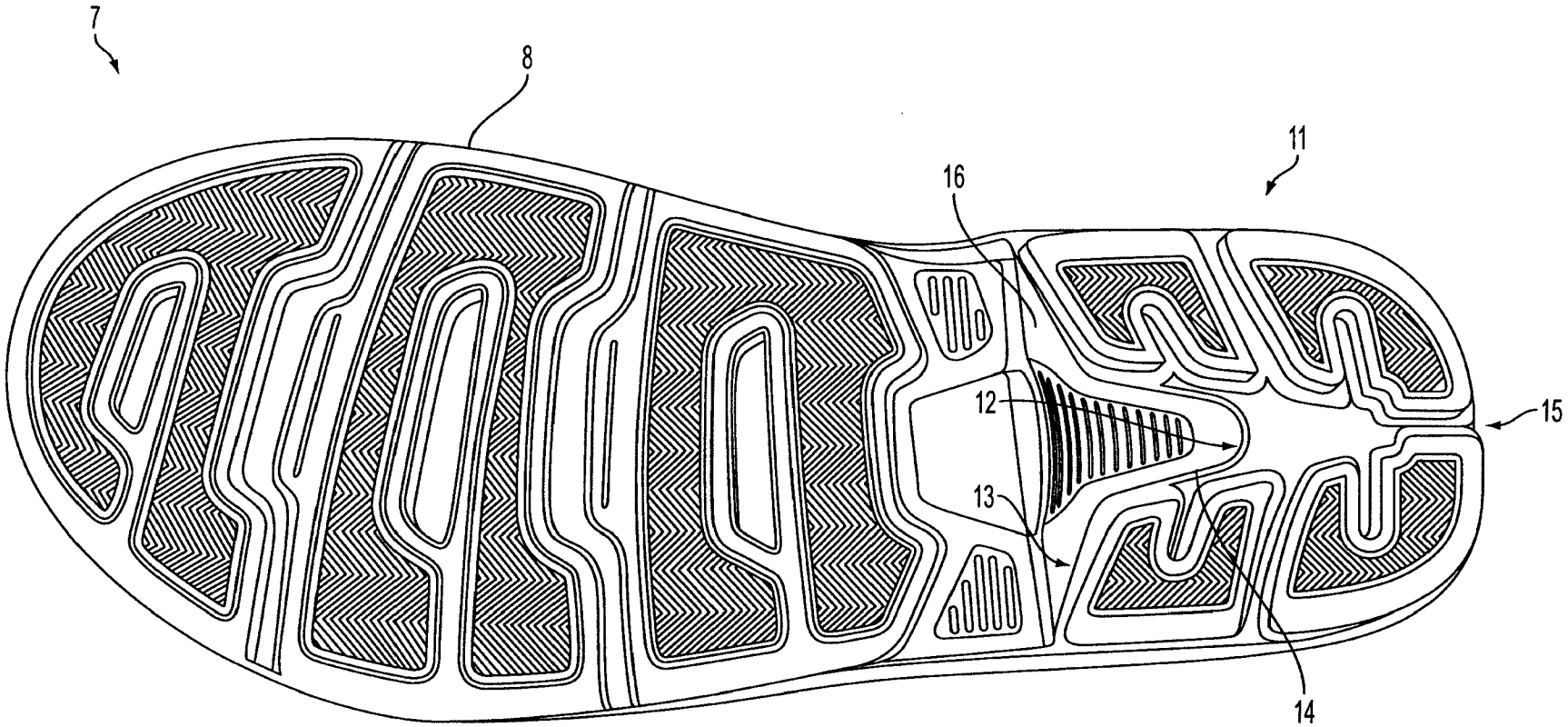
FIG. 3 is a bottom view of the sandal of FIG. 1 in accordance with an embodiment of the present invention.

FIG. 3 is a bottom view of the sandal 1 of FIG. 1 in accordance with an embodiment of the present invention. FIG. 3 depicts heel insert 16 positioned inside heel cavity 12. Heel insert 16 can be slidably inserted into heel cavity 12 through open front portion 13, and is secured within heel cavity 12 upon contact with closed rear portion 15. Heel inserts of various sizes, thicknesses and rigidities can be placed inside heel cavity 12 depending on the user's desired level of support, cushioning and comfort. For example, a user that weighs over 200 pounds may want a more rigid heel insert than a user that weighs 100 pounds.

Figure 4:
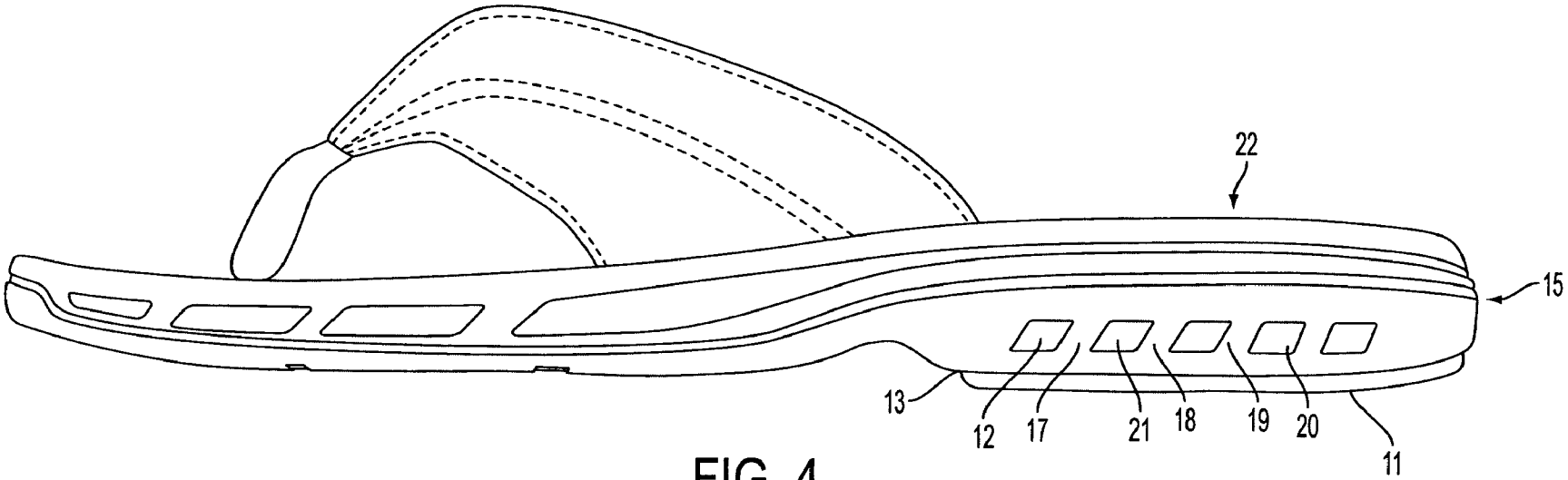
FIG. 4 is a side view of the sandal of FIG. 1 without a heel insert placed inside a heel portion of the sandal in accordance with an embodiment of the present invention.

FIG. 4 is a side view of the sandal 1 of FIG. 1 without a heel insert placed inside a heel portion of the sandal in accordance with an embodiment of the present invention. Heel cavity 12 is defined by side wall 17, open front portion 13, closed rear portion 15, heel surface 11 on the bottom, and rear portion 22 of upper surface 2 on the top. Side wall 17 is further defined by connectors 18 and 19 which are spaced apart by openings 20 and 21 along the perimeter of side wall 17. Connectors 18 and 19 are preferably flexible to allow heel cavity 12 to expand to accommodate heel inserts of various sizes. Both sides of the sandal 1 may have connectors 18 and 19 which are spaced apart by openings 20 and 21.

Figure 5:
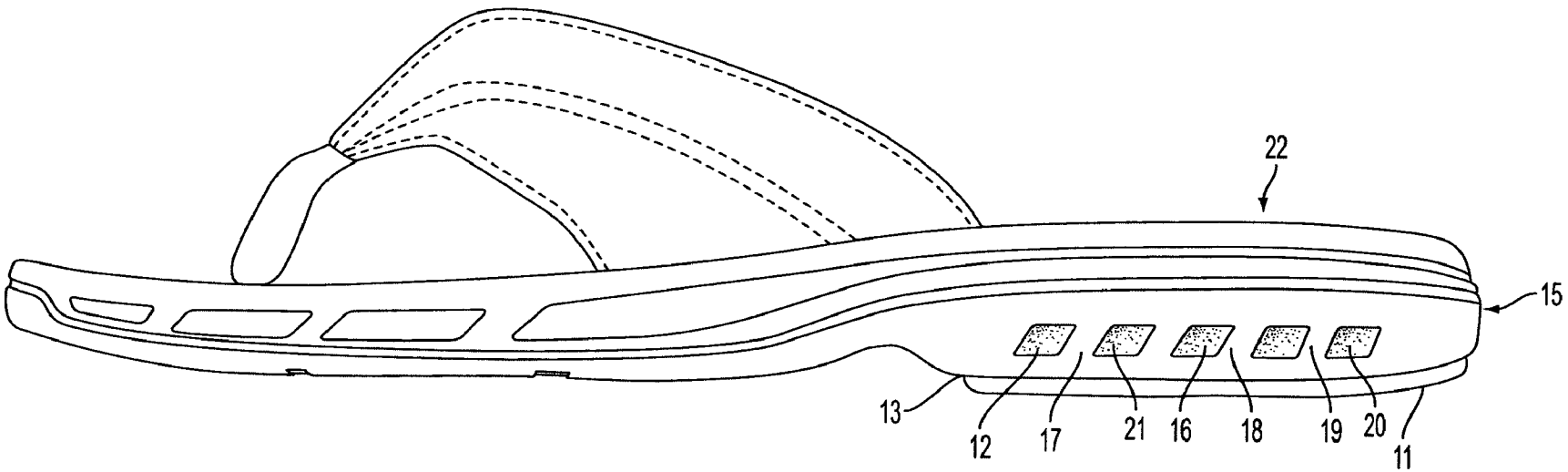
FIG. 5 is a side view of the sandal of FIG. 1 with the heel insert placed inside the rear portion of the sandal in accordance with an embodiment of the present invention.

FIG. 5 is a side view of the sandal 1 of FIG. 1 with the heel insert 16 placed inside the rear portion 22 of the sandal 1 in accordance with an embodiment of the present invention. Heel insert 16 is slidably inserted into heel cavity 12 through open front portion 13 until heel insert 16 comes into contact with closed rear portion 15. Heel insert 16 can be seen inside heel cavity 12 through openings 20 and 21 in side wall 17. Heel insert 16 is not permanently affixed to heel surface 11 or inside heel cavity 12, but rather temporarily secured within heel cavity 12 and easily removable and interchangeable with another heel insert.

Figure 6:
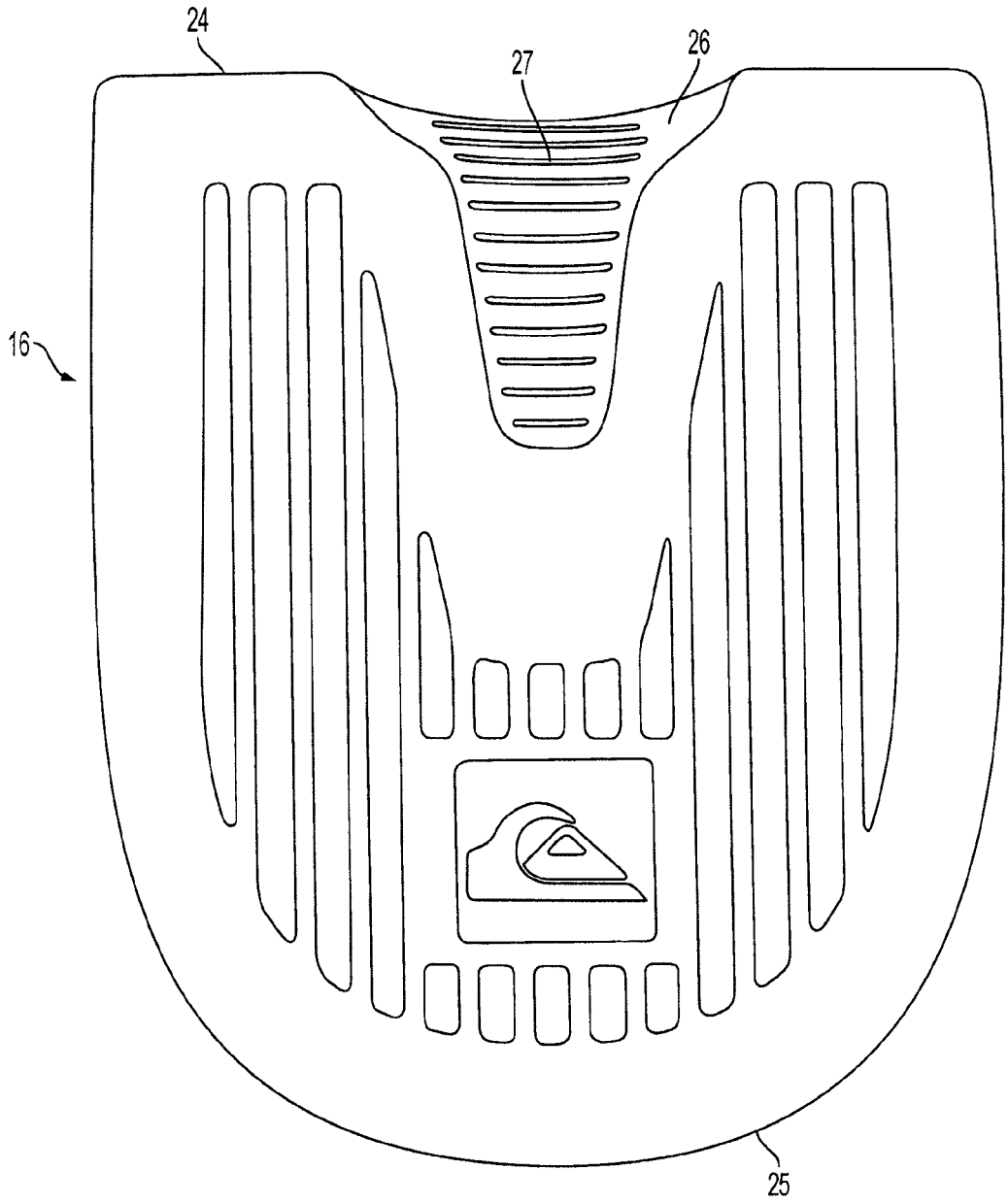
FIG. 6 is a top view of a heel insert in accordance with an embodiment of the present invention.

FIG. 6 is a top view of a heel insert 16 in accordance with an embodiment of the present invention. Heel insert 16 preferably generally has the same shape as heel surface 11, so that the entire heel area of sandal 1 is supported by heel insert 16. Heel insert 16 preferably comprises a substantially flat front surface 24 and a semicircular rear surface 25. A concave recessed groove 26 is positioned at front surface 24, and includes gripping means 27. Gripping means 27 may be raised ridges, indentations, grooves, or any other means which improve the user's finger grip of recessed groove 27. Recessed groove 26 is used to assist the user in inserting and removing heel insert 16 to and from heel cavity 12.

In the preferred embodiment, heel insert 16 is fabricated from a lightweight rigid material, such as rubber, in order to minimize the weight of sandal 1. Preferably, heel insert 16 is a single piece of molded, durable and hard wearing elastomeric material such as rubber or rubber composition material, although it will be apparent that various other materials of a semi-elastomeric or even slightly rigid material, including various plastic, foam, foam composites, or resinous substances, polymeric materials, and the like, including leather, composite leather, or wood may be employed. However, a somewhat elastomeric and at least partly flexible material is preferred in order to impart to the shoe a flexible, comfortable nature while the user is walking. In one embodiment, heel insert 16 may be an air bag filled with air. The amount of air in the air bag can be adjusted for improved support and comfort.

Heel insert 16 can be color coded to correspond to a particular activity. For example, a red insert may correspond to a high level of support and less cushioning, while a yellow insert may correspond to a high level of cushioning and less support. A green heel insert 16 may be used for leisure activities. The user can easily determine the appropriate heel insert to use for an activity based on the color. In one embodiment, a first insert may have a hardness of between about 20 and 30 Asker C, a second insert may have a hardness of between about 30 and 40 Asker C, and a third insert may have a hardness of between about 40 and 50 Asker C.

Figure 7:
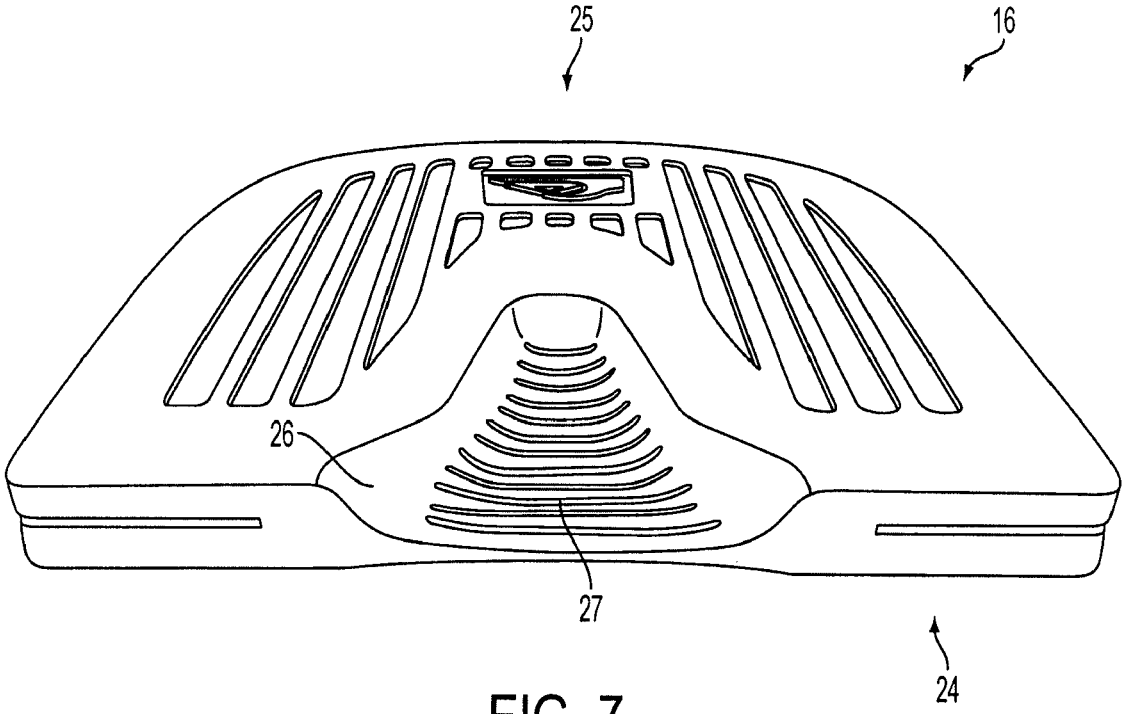
FIG. 7 is a perspective view of the heel insert of FIG. 6 in accordance with an embodiment of the present invention.

FIG. 7 is a perspective view of heel insert 16 of FIG. 6 in accordance with an embodiment of the present invention. Recessed groove 26 is preferably indented in a concave manner to accommodate the user's finger. Gripping means 27 is positioned along the entire surface of recessed groove 26 to provide a sufficient grip for the user's finger. A convex side of recessed groove 26 (not shown) is shaped in a convex manner corresponding to the concave surface of recessed groove 26. The convex side may also contain gripping means. The convex side may be positioned below the concave side when heel insert 16 is positioned inside heel cavity 12. Recessed center portion 14 allows recessed groove 26 (see also FIG. 3) to be exposed so the user's fingers can easily insert and remove heel insert 16.

Figure 8:
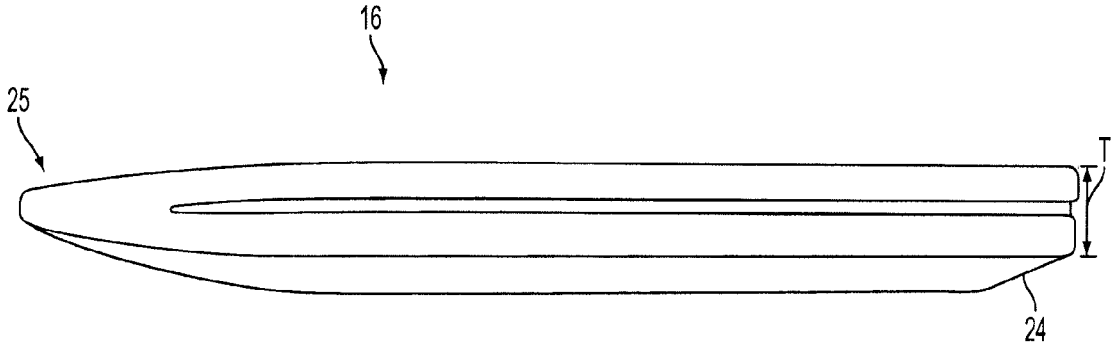
FIG. 8 is a side view of the heel insert of FIG. 6 in accordance with an embodiment of the present invention.

FIG. 8 is a side view of the heel insert of FIG. 6 in accordance with an embodiment of the present invention. Thickness T is the height of heel insert 16. Heel insert 16 is removable from heel cavity 12, allowing the user to replace a heel insert with other heel inserts of varying thicknesses, each thickness corresponding to a different level of support, cushioning and comfort.

Figure 9:
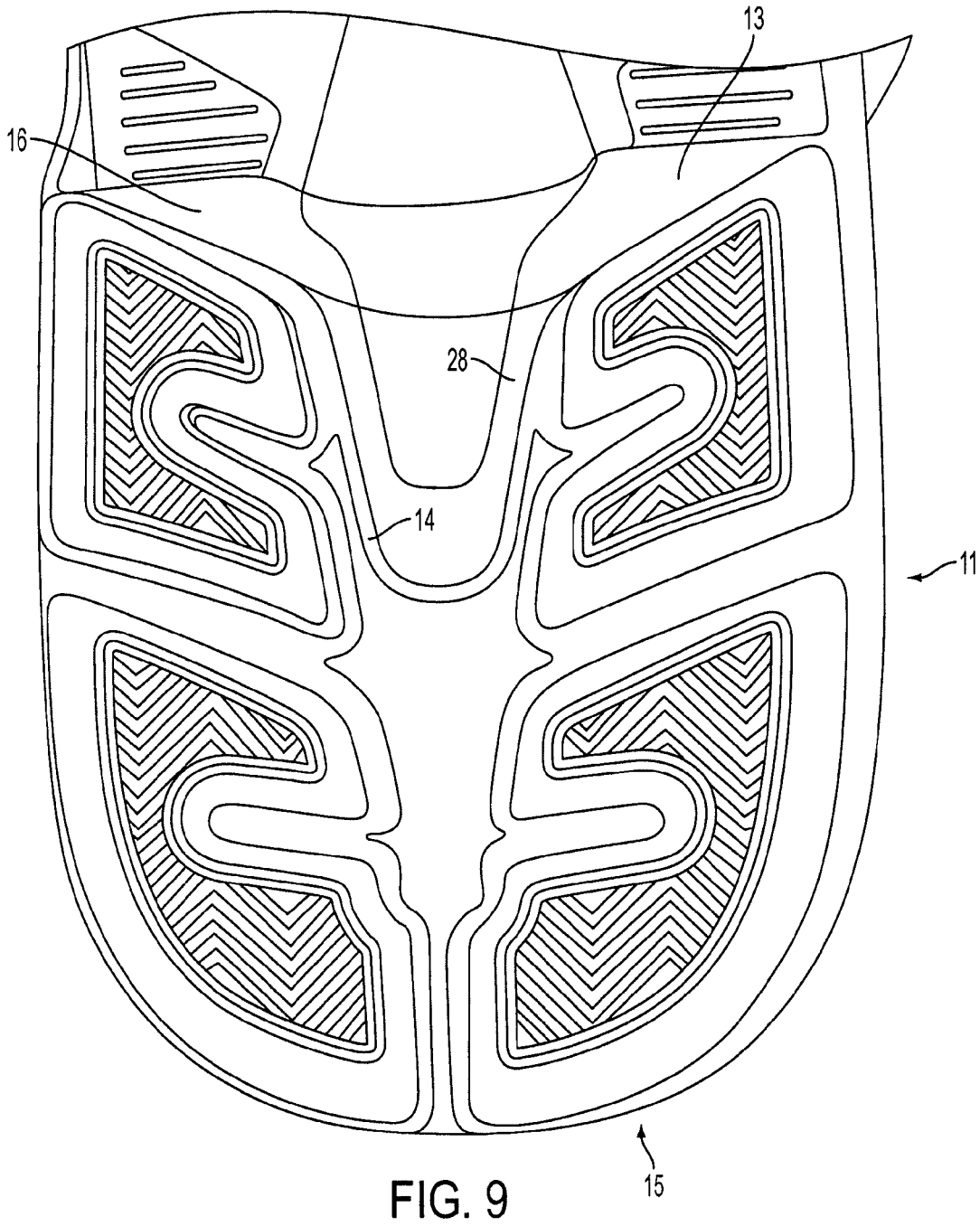
FIG. 9 is a bottom view of the heel portion of the sandal of FIG. 1 with the heel insert placed inside the heel cavity of the sandal in accordance with an embodiment of the present invention.

FIG. 9 is a bottom view of the heel portion of the sandal of FIG. 1 with the heel insert 16 placed inside the heel cavity 12 of the sandal 1 in accordance with an embodiment of the present invention. Heel insert 16 is placed within heel cavity 12 through open front portion 13. Heel surface 11 comprises a recessed portion 14 shaped to accommodate convex portion 28 of heel insert 16.

The invention is not limited to sandals and open-toe footwear, and can be employed on various articles of footwear such as shoes, boots, slippers, and other closed-toe articles of footwear.

While the specification has been disclosed in relation to the exemplary and non-limiting embodiments provided herein, it is noted that the inventive principles are not limited to these embodiments and include other permutations and deviations without departing from the spirit of the present invention.

What is claimed is:

1. A sole with an adjustable heel support comprising:

a front portion adapted to support a ball of a user's foot;

a heel portion adapted to support a heel of the user's foot, the heel portion having an upper surface, a lower surface, an open front portion, a closed rear portion, and two side walls, the two side walls being undetachably coupled to the upper surface and the lower surface, and at least one of the two side walls having at least one opening;

a cavity defined within the heel portion, from the open front portion to the closed rear portion; and a removable insert positioned within the cavity and configured to be slidably removable from the cavity via the open front portion, wherein the removable insert is made from an elastomeric material.

2. The sole of claim 1, wherein the heel portion is expandable to receive removable inserts of varying sizes.

3. The sole of claim 1, wherein the removable insert has a lower surface and an upper surface, and the lower surface of the removable insert has substantially the same shape as the lower surface of the heel portion.

4. The sole of claim 1, wherein the removable insert is configured to have a color corresponding to a specific level of hardness of the removable insert, the color of the removable insert, positioned within the cavity, being visible from the exterior of the cavity through the at least one opening.

5. The sole of claim 1, wherein the sole is affixed to a closed-toe or an open-toe article of footwear.

6. A sole with an adjustable heel support comprising:

a front portion adapted to support a ball of a user's foot;

a heel portion adapted to support a heel of the user's foot;

a cavity defined within the heel portion; and a removable insert positioned within the cavity, the removable insert being an air bag.

7. An article of footwear comprising:

an upper surface adapted for placement of a user's foot;

a sole undetachably coupled to the upper surface of the article of footwear, the sole having a front portion adapted to support a ball of the user's foot and a heel portion adapted to support a heel of the user's foot, the heel portion having an upper surface, a lower surface adapted for placement on a ground surface, and two side walls, and the heel portion having an open front portion and a closed rear portion;

a cavity defined within the heel portion of the sole, from the open front portion to the closed rear portion;

a removable insert placed inside the cavity through the open front portion to adjust the level of support provided to the heel; and a plurality of connectors positioned on each side wall connecting the upper surface of the heel portion and the lower surface of the heel portion.

8. An article of footwear comprising:

a sole having a front portion adapted to support a ball of a user's foot and a heel portion adapted to support a heel of the user's foot, the heel portion having an upper surface, a lower surface adapted for placement on a ground surface and having a recessed opening positioned at a front portion of the lower surface, and two side walls, and the heel portion having an open front portion and a closed rear portion;

a cavity defined within the heel portion of the sole, from the open front portion of the heel portion to the closed rear portion of the heel portion; and a removable insert placed inside the cavity through the open front portion of the heel portion to adjust the level of support provided to the heel, the recessed opening defining a gripping area for fingers positioned at a front portion of the heel portion.

9. The article of footwear of claim 8, wherein the two side walls are flexible.

10. The article of footwear of claim 8, further comprising a closed toe portion attached to the sole and adapted to cover the user's toes.

11. A sandal comprising:

an upper surface adapted for placement of a user's foot;

a securing device on the upper surface and adapted to receive the user's foot;

a sole undetachably coupled to the upper surface and having a front portion adapted to support a ball of the user's foot and a heel portion adapted to support a heel of the user's foot, the heel portion having an upper surface, a lower surface adapted for placement on a ground surface and having a recessed opening positioned at a front portion of the lower surface, and two flexible side walls, and the heel portion having an open front portion and a closed rear portion;

a cavity defined within the heel portion, from the open front portion of the heel portion to the closed rear portion of the heel portion;

a plurality of connectors positioned on each side wall connecting the upper surface of the heel portion and the lower surface of the heel portion; and a removable insert placed inside the cavity through the open front portion of the heel portion to adjust the level of support provided to the heel, the recessed opening defining a gripping area for fingers positioned at the front portion of the lower surface.

12. The sandal of claim 11, wherein the removable insert comprises a recessed groove adapted to receive fingers for gripping.

13. The sandal of claim 11, wherein the removable insert comprises a concave side and a convex side, the concave side and the convex side adapted to receive fingers for gripping.

14. The sandal of claim 11, wherein the recessed opening is adapted to receive a convex portion of the removable insert.

15. The sandal of claim 11, wherein the sole is made from one of a polyurethane, ethylene vinyl acetate, or a rubber compound.

16. The sandal of claim 11, wherein the plurality of connectors are spaced apart by openings in each side wall.

17. The sandal of claim 11, wherein the removable insert has a hardness of between about 20 and 50 Asker C.

18. The sandal of claim 11, wherein the securing device comprises a thong strap.

19. A sole with an adjustable heel support comprising:

a front portion adapted to support a ball of a user's foot;

a heel portion adapted to support a heel of the user's foot, the heel portion having an upper surface, a lower surface, an open front portion, a closed rear portion, and two side walls, the two side walls being undetachably coupled to the upper surface and the lower surface, and at least one of the two side walls having at least one opening;

a cavity defined within the heel portion, from the open front portion to the closed rear portion; and a removable insert positioned within the cavity and configured to be slidably removable from the cavity via the open front portion, wherein the heel portion is expandable to receive removable inserts of varying sizes.

20. A sole with an adjustable heel support comprising:

a front portion adapted to support a ball of a user's foot;

a heel portion adapted to support a heel of the user's foot, the heel portion having an upper surface, a lower surface, an open front portion, a closed rear portion, and two side walls, the two side walls being undetachably coupled to the upper surface and the lower surface, and at least one of the two side walls having at least one opening;

a cavity defined within the heel portion, from the open front portion to the closed rear portion; and a removable insert positioned within the cavity and configured to be slidably removable from the cavity via the open front portion, wherein the removable insert is configured to have a color corresponding to a specific level of hardness of the removable insert, the color of the removable insert, positioned within the cavity, being visible from the exterior of the cavity through the at least one opening.

* * * * *